US005287816A

United States Patent [19]

Jungpeter et al.

[11] Patent Number: 5,287,816

[45] Date of Patent: Feb. 22, 1994

[54] PALLET FOR TRANSPORTING CYLINDRICAL OBJECTS AND HOLDER FOR SUPPORTING THEIR CENTERAL TUBE

[75] Inventors: Raymond R. Jungpeter, Toernich, Belgium; Lucien J. Bodson, Keispelt, Luxembourg

[73] Assignee: E. I. du Pont De Nemours & Company, Wilmington, Del.

[21] Appl. No.: 805,043

[22] Filed: Dec. 11, 1991

[30] Foreign Application Priority Data

Dec. 18, 1990 [FR] France ..... 90 15837

[51] Int. Cl.[5] ..... B65D 19/44

[52] U.S. Cl. ..... 108/55.1

[58] Field of Search ..... 108/55.1, 55.3, 56.1, 108/51.1, 53.3, 53.1, 53.5, 55.5; 211/13; 206/386, 600

[56] References Cited

U.S. PATENT DOCUMENTS

| | | | |
|---|---|---|---|
| 2,632,567 | 3/1953 | Richtmyer | 211/13 |
| 2,762,514 | 9/1956 | McGinn . | |
| 2,962,167 | 11/1960 | Storey et al. | 211/13 |
| 3,152,670 | 10/1964 | Selkregg Jr. et al. | 211/187 |
| 3,590,752 | 7/1971 | De Pew | 108/53.5 |
| 3,857,494 | 12/1974 | Giardini | 108/53.5 |
| 4,151,914 | 5/1979 | Blatt | 206/386 |
| 4,921,101 | 5/1990 | Gatt . | |

FOREIGN PATENT DOCUMENTS

| | | | |
|---|---|---|---|
| 0464428 | 1/1992 | European Pat. Off. | 206/600 |
| 7128753 | 7/1971 | Fed. Rep. of Germany . | |
| 7920845 | 7/1979 | Fed. Rep. of Germany . | |

*Primary Examiner*—Peter R. Brown
*Assistant Examiner*—Janet M. Long

[57] ABSTRACT

A pallet is provided for supporting the central tube of cylindrical objects having a variable outside diameter, the pallet consisting of a pallet base of generally rectangular shape with uprights mounted at the four corners thereof and detachable panels arranged in parallel pairs mounted between the uprights, the panel including means for securing them to the base and means for rendering them integral with the uprights, the panels further including at least one slotted portion having guiding means which cooperate with a holder member for an end of said central tube, the holder member being supported by a detachable cross member adapted to be fixed at differing levels within the slotted portion, the pallet being particularly suitable for supporting rolls of film material of variable diameters and length.

31 Claims, 6 Drawing Sheets

10a
10b
7a
7b
14
8b
9b
10
16
16
44
15a
19c
12
24
49
20
20
25
9
16
43
7
25
8a
4
32
36a
6
3
1
5
2
8
3

PALLET FOR TRANSPORTING CYLINDRICAL OBJECTS AND HOLDER FOR SUPPORTING THEIR CENTERAL TUBE

BACKGROUND OF THE INVENTION

The present invention relates to a pallet structure designed to support the central tubes of cylindrical objects of variable outside diameter, said structure comprising a base portion of generally rectangular shape with uprights secured at each of it four corners. The invention also discloses holder members which are used with the pallet and which support the ends of the central tubes of such cylindrical bodies.

A large variety of pallets or containers of generally parallelepiped shape are known which are designed to hold and retain parts of a specific shape such as cylindrical or spherical vessels or rolls or coils of striplike material which are of generally cylindrical shape. The pallets or containers are designed to be handled by a fork-lift truck the tines of which support the base portion of the pallet typically loaded with rolls, which are loaded from above. In a known design of a pallet for carrying rolls, semi-cylindrical support members are provided which constitute bearing surfaces that are integral with the walls of the pallet, and these are used to support specially designed cylindrical pin members which are fitted into the central tube around which the rolls of striplike materials are wound. The semi-cylindrical support members are rigidly secured to the walls of the pallet thus making it possible to create a rigid and fairly solid structure. Experience has however shown that such a pallet structure does not have the required flexibility of use and is generally only suitable for transporting one single type of roll. Attempts to provide a pallet suitable for transporting rolls of film material of different sizes gave rise to a complex pallet structure including numerous semi-cylindrical support members which were permanently attached to the walls thereof, with the result that the pallet is expensive to produce. Additionally, during unloading, the rolls sometimes collide with the walls of the pallet and it was necessary to provide a special packaging for the rolls of film.

It is hence a principal object of the present invention to provide a pallet which is readily adaptable to the transporting of several types of roll without requiring the use of disposable packaging material and the associated problems of pollution when disposing of it, at a relatively limited cost.

A further object of the invention is to provide a pallet which, while being suitable for transporting numerous types of rolls of differing diameter and axial length, includes modular components for supporting the ends of the central tube of such rolls, with it being possible to readily change the place of such modular components or replace one by another, thus leading to a corresponding reduction in the costs of manufacturing and assembling the pallets.

A further object of the invention is to provide a pallet of generally parallelepiped shape in which it is possible to arrange rolls of film or striplike material constituting cylindrical objects incorporating a central support tube in either of the two principal directions (lengthwise and widthwise) of the pallet.

It is a further object of the invention to provide pallets which can be readily stacked or fitted one on top of the other and which are truly universal as regards their capacity to accommodate rolls of any dimensions with the possibility of locking the rolls in position inside the pallet structure.

A further object of the invention is to provide special end holders for the two ends of the central tube of such rolls which can either be extracted in the upwards direction from special recesses designed to receive them or can be removed axially by turning them through 90°. Such holders must enable a lifting bar to be introduced axially into the central tube of the cylindrical object to enable the latter to be lifted out of the pallet by lifting apparatus acting on said bar.

A further object of the invention is to facilitate loading and unloading of rolls of film material by eliminating the intermediate steps of packing and unpacking such rolls and, as a consequence, reducing the risks of contamination and damaging of the film material carried on such rolls while eliminating any recourse to conventional packing means such as wooden pallets, cardboard boxes, and intermediate and final packages using plastics material.

SUMMARY OF THE INVENTION

In accordance with the invention, at least two detachable support means or panels are fitted in pairs between the uprights of the pallet, each pair being parallel, the support means including means for mounting them on the pallet base and means for rendering them integral with the uprights, the support means including, at least at their upper region, an open area or slotted portion the side walls of which are provided with guiding means adapted to cooperate with matching guiding means provided on a holder member for an end of said central tube, said holder member resting on a detachable cross member adapted to be fitted at differing levels within said slotted portion.

According to one feature of the pallet, four detachable support means arranged by parallel pairs and all having the same outside dimensions are fitted between the uprights and the widest sides of the pallet include at each end thereof a supplementary upright linked by bracing members to the corresponding corner upright, the supplementary uprights of one side being spaced from each other by a distance that corresponds to the width of said support means. A support means is generally made up by at least four vertical tubular parts mutually connected by bracing members, the lateral tubular parts thereof cooperating with the uprights by means of rigid fixing means while said open area is formed between two central tubular parts and/or between a lateral tubular part and a central tubular part.

According to further features, the lateral sides of the open area portion are each formed by a tube of rectangular cross-section carrying means for securing the detachable cross member at corresponding differing levels. Advantageously, the support means are constituted by an assembly of tube portions each having the same cross-section.

Advantageously, when the upper region of at least one of the corner uprights includes a projecting portion adapted to fit into a corresponding cavity provided in a foot of the pallet base of another pellet, said cavity being preferably provided in the lower region of a corner upright to enable stacking of the pallets to be achieved. The holder member can be adapted to be locked in position by means of a second removable cross member.

According to yet a further feature, the holder member includes a portion generally in the form of a rectangular plate on two parallel lateral sides of which means for guiding are provided which cooperate with the guiding means provided on the lateral edges of the slotted portion and wherein said rectangular plate part carries on one side thereof and projecting perpendicularly therefrom, a tube support part of generally cylindrical shape and of diameter slightly less than the inside diameter of the central tube that is to be supported.

The rectangular plate part and said tube support part are advantageously provided with one or two passages lying on the vertical axis of the plate part and the mouth(s) of which lie on a side which is not a lateral side thereof. The passage(s) in said tube support part is/are surrounded by a wall which joins the cylindrical wall of the tube support part.

The means for guiding on each lateral side of the holder member are made up by a rectilinear channel adapted to slide on a rectangular cross-section tube defining the lateral edge of the slotted portion. Alternatively, the means for guiding on each lateral edge of said holder member are made up by a channel having a cylindrical base adapted to slide on a rectangular cross-section tube defining the lateral edge of the slotted portion, to allow the holder member to rotate while bearing against one lateral edge of the slotted portion.

According to another feature, the two parallel sides of said holder member which are not the lateral sides thereof are spaced from each other by a distance which is slightly less than the width of the slotted portion whereby, after rotation through about 90° of said rectangular plate part, the holder member can be withdrawn axially from said slotted portion. The means for guiding on each lateral side of said holder member are made up by a channel having a cylindrical base adapted to slide on a rectangular cross-section tube defining the lateral edge of said slotted portion. The tube support part is advantageously located eccentrically with respect to the two lateral edges of the rectangular plate part. The fact of then disposing the rectangular plate part in one sense or the other brings about a lateral shift of the tube support part so that the rolls carried inside the pallet can be arranged most advantageously, particularly by enabling them to be staggered.

According to a further feature of the holder member, at least two of its opposing lateral edges each include at least one projecting portion and at least one recess and the projecting portion of a first edge is adapted to penetrate into a corresponding recess of the lateral edge opposing said first edge, whereby at least two holder members can be mutually stacked by juxtaposition of their said rectangular plate parts. When the four lateral edges of said holder member incorporate at least one projecting portion and at least one recess, a projecting portion and/or a recess of one lateral edge only matches respectively a recess and/or a projecting portion of the opposing lateral edge of said holder member whereby only one single stacking orientation of a plurality of said holder members is possible.

According to a further feature, the detachable cross member is made up by two bars consisting of a load-bearing bar supporting said holder member, the length of which is greater than the distance between the lateral edges of the slotted portion, and of a locking bar the length of which is slightly less than said distance between the lateral edges of the slotted portion, said two bars being linked by crosspieces disposed substantially perpendicular thereto, the outermost ones of which are located at a distance from each end of the load-bearing bar, whereby a length of said load-bearing bar that is greater than half the difference in length between the two said bars is left free. According to another feature, at least one annular spacing insert can be mounted on the tube support part of the holder member.

The characteristics of the holder member which is designed for use with the pallet are described in detail below.

Other objects, advantages and features of the invention will become more clear from a reading of the detailed description which follows taken in conjunction with the attached drawings, provided by way of non-limiting example.

DETAILED DESCRIPTION OF PREFERRED EMBODIMENTS

Figure 1:
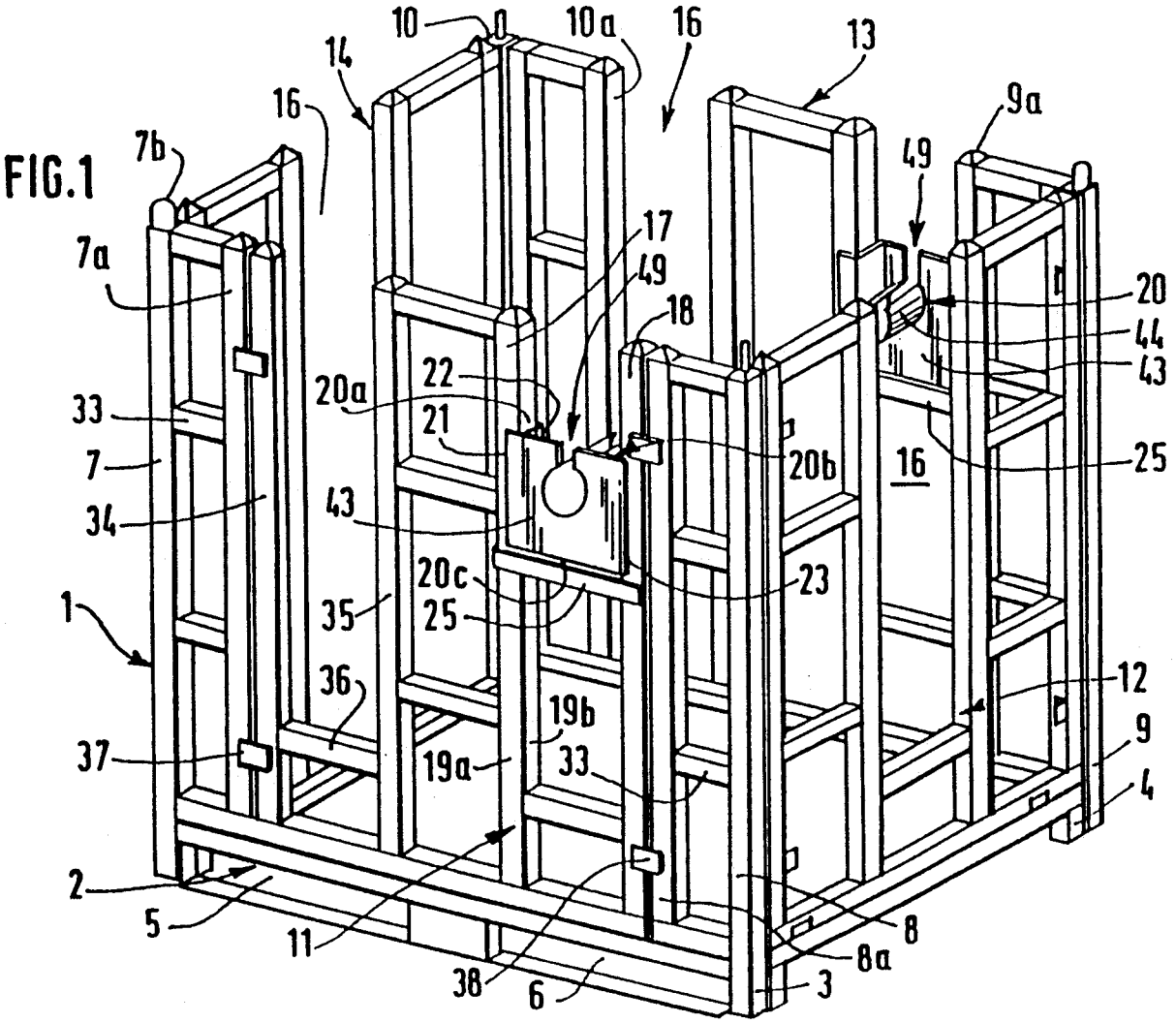
FIG. 1 is a perspective view of a pallet structure in accordance with the invention.
Figure 2:
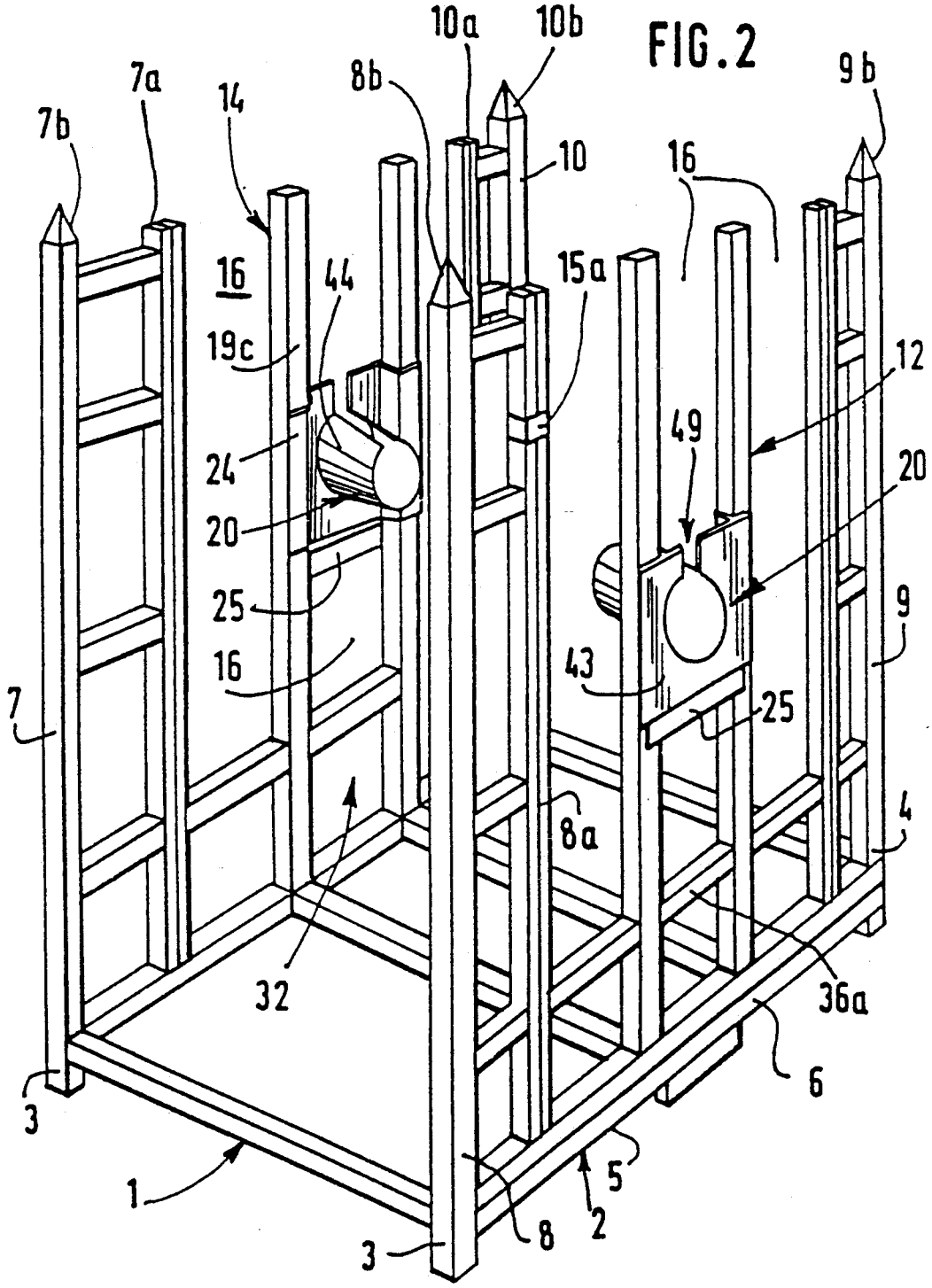
FIG. 2 shows also in perspective and in a top view, a simplified embodiment of the pallet structure in accordance with the invention.

If reference is now made to the perspective views in FIGS. 1 and 2, the pallet structure 1 for supporting the central tubes of rolled striplike material is mounted on a pallet base 2 of generally rectangular shape provided with feet 3, 4 and with passages 5, 6 for receiving the arms of a conventional forklift truck. The pallet base carries uprights 7, 8, 9, 10 rigidly secured at each of its corners and these define a framelike structure around the usable loading volume 32 of the pallet above the base 2.

At least two detachable support means or panels are mounted on the uprights 7 to 10 in parallel pairs (see FIG. 2 where the pallet structure 1 only includes two panels 12, 14 arranged opposite each other). These support means or panels 11, 12, 13, 14, which are not necessarily all identical in order to take account of the rectangular shape of the pallet base, include means for mounting them on the base 2, for example, by projecting pin members which fit into holes in the pallet base 2 (see the pins 15 in FIG. 4). The pin members 15 can be replaced by brackets or lugs or the like (see the lugs 37, 38 in FIG. 4 and described below) which partially overlap the panels and/or the tubular members of the framelike pallet structure 1. The support means 11 to 14, for reasons of weight reduction and accessibility, do not form a continuous wall but rather a framelike structure consisting of sections of tube, notably square cross-section tube, and which can be joined to the uprights 7 to 10 by rigid fixing or engaging means, for example, by a common clamping ring 15*a* (FIG. 2) or by a system employing releasable hook members carried by the panel or by the upright with the hook members fitting into a hole or engaging behind a retaining tab respectively provided on the associated component comprising either the upright or the panel.

Each support means 11 to 14 includes at least one slotted portion 16 which is open at the top in the service position of the support means. The side walls of the open area or slotted portion 16, consist of square or rectangular cross section tubes 17, 18 defining the open area 16, and provided with guiding means. These guiding means consist of the outer walls 19*a*, 19*b*, 19*c* of the rectangular cross-section tubes and constitute a parallel-sided slideway. The walls 19*a* and 19*b* can be seen on the tube 17 of FIG. 1 while the wall 19*c* which faces the inner volume of the pallet can be seen in FIG. 2.

A holder member 20 for one end of the central tube of a roll fits into the open area 16 and is guided by the guiding means 19*a* to 19*c*. The holder member 20 also carries matching guiding means which for example consist of pairs of projecting lugs 21, 22 and 23, 24 on each of the lateral sides thereof (see lug 24 in FIG. 2 and lugs 21, 22 and 23 in FIG. 1) which form, together with the body of the holder member 20, on each lateral edge, a channel 20*a*, 20*b* the three outer walls embracing the tubular slideway made up by the tubes 17 or 18.

Figure 3A:
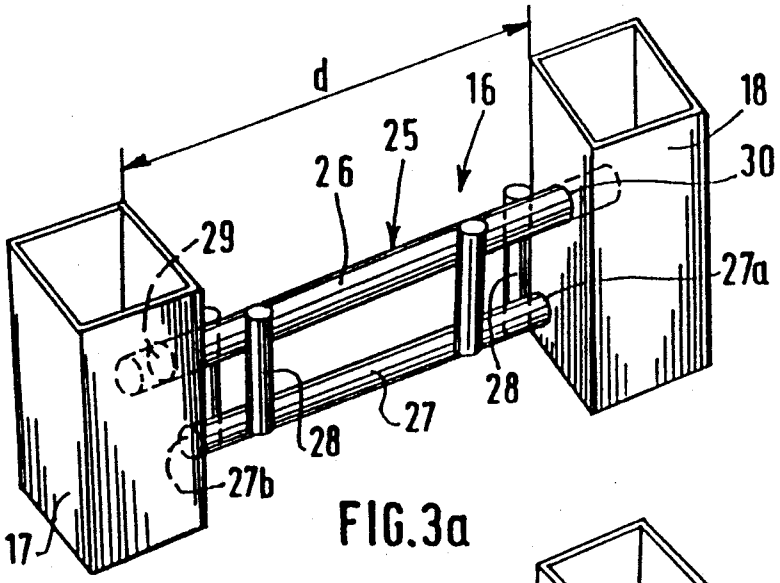
FIG. 3*a* and 3*b* show fragmentary perspective views of the means for retaining and locking the holder members that support the ends of the central tubes, firstly in the locked position and then in the course of being transferred to another position.
Figure 3B:
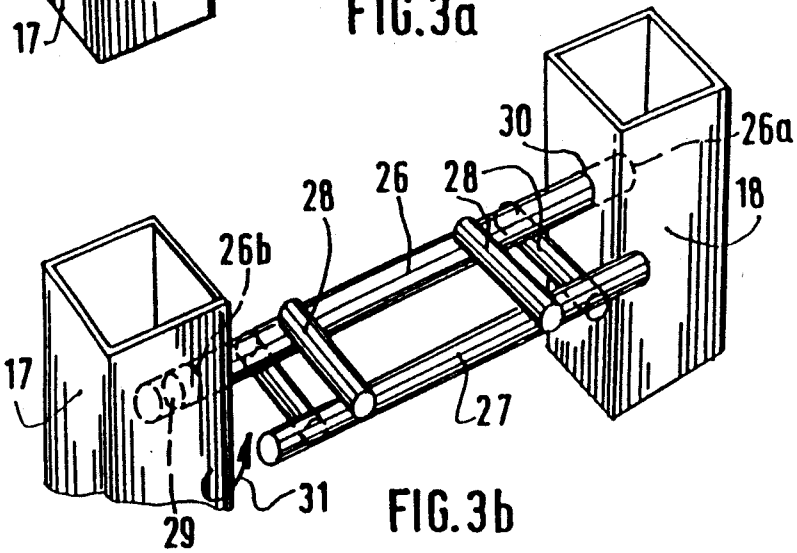

The holder member 20 rests under its own weight on a detachable cross member 25 which is secured at each end thereof, to cross section tubes 17, 18 defining slotted portion 16, at differing heights. One type of cross member 25 is shown in FIGS. 3*a* and 3*b* which can be locked in position by the effect of gravity. The cross member 25 consists of two solid or hollow bars 26 and 27 which are joined together by two pairs of welded short rod members 28 so as to constitute perpendicular cross-pieces, the bars 26 and 27 being spaced from each other by a distance that is greater than half the distance of the side of the tube sections 17 and 18 that define the lateral edges of the slotted portion 16. Bar 26 constitutes a load-bearing bar which supports the holder member 20 resting thereon by means of its lower edge 20*c*. The lower edge 20*c* can, if necessary, include a channel into which the bar 26 and the bar 27 can fit in order to immobilize them in position. The length of bar 26 is greater than the distance d between the two lateral edges of the slotted portion 16. Bar 27 constitutes a locking bar the length of which is slightly less than the distance d. The crosspieces 28 which are closest to the ends of the bars are spaced away from the end 26*a* or 26*b* of the load-bearing bar 26 thus leaving the ends thereof free over a length that is greater than half the difference in length between the two bars.

When the bar 27 is moved outside the open area 16 by rotation of bar 26 and no longer bears against the sides of upright tube sections 17, 18, an end portion 26*a* of bar 26 can be pushed into one of the holes 30 of upright 18 up to the point where the other end portion 26*b* of the bar 26 can be introduced into the slotted portion 16 opposite a hole 29 provided in tube 17. The bar 26 can then be simultaneously engaged in the two holes 29 and 30 of the tubes 17 and 18, the bars 26 and 27 remaining rotated in the direction of arrow 31 in the transverse position as shown in FIG. 3*b*. If now the shorter bar 27 is allowed to fall under gravity, it takes up a position where it is housed between the two tubes 17 and 18 thus preventing, through its end portions 27*a* and 27*b*, the longer bar 26 from coming out of the holes 29 and 30. The cross member 15 is removed by reversing the above operations. The cross member 25 can hence be readily moved to different levels in the same open area 16 and/or different open area, in order to correctly position the rolls of film material in the inner space 32 of the pallet.

FIG. 1 shows a pallet structure that includes four support means 11 to 14 which can have the same outer dimensions over two sides of the pallet 1, these sides having differing widths. To achieve this, the widest sides of the pallet 1 include supplementary uprights 7*a* to 10*a* which are linked together by bracing struts 33 to the corresponding corner uprights 7 to 10. The supplementary uprights of one wider side, for example 7*a*, 8*a* are spaced from each other by a distance that corresponds to the width of a panel 11. The support means 11 to 14 include, in addition to the tubular elements 17 and 18 which form the sides of the an open area 16, at least two further vertical tubular elements 34 and 35. The various vertical elements 17, 18, 34, 35 of a panel are joined together by bracing members 36 which can act as a lower abutment 36*a* for a open area 16. The lateral tubular elements (18 and 34 for panel 11 shown in FIG. 1) cooperate with the uprights secured to the pallet base 2, ("uprights" here meaning either the corner uprights 7 to 10 or the supplementary uprights 7*a* to 10*a*) via a rigid fixing means for example consisting of lugs 37, 38 carried on the panel 11 or on the uprights. As will be seen in FIG. 1, the open area 16 is formed between the two central tubular elements 17 and 18 for panel 12 in order to mount a roll on the axis of the panel or between a lateral tubular element 34 and a central tubular element 18 for panel 11 in order to mount two parallel rolls in the pallet. The support means. are preferably formed by a welded structure and, in order to facilitate welding, the tubular elements that make them up all have the same cross-section.

The pallets are preferably designed to be stacked one on top of the other, and to achieve this the upper portion of at least one of the corner uprights 7 to 10*a* includes a projecting portion 7*b* to 10*b* adapted to fit in a corresponding cavity provided in a foot 3 or 4 of the pallet base 2. The feet 3 and 4 are preferably constituted by the lower portion of the corner uprights 7 to 10.

Figure 5:
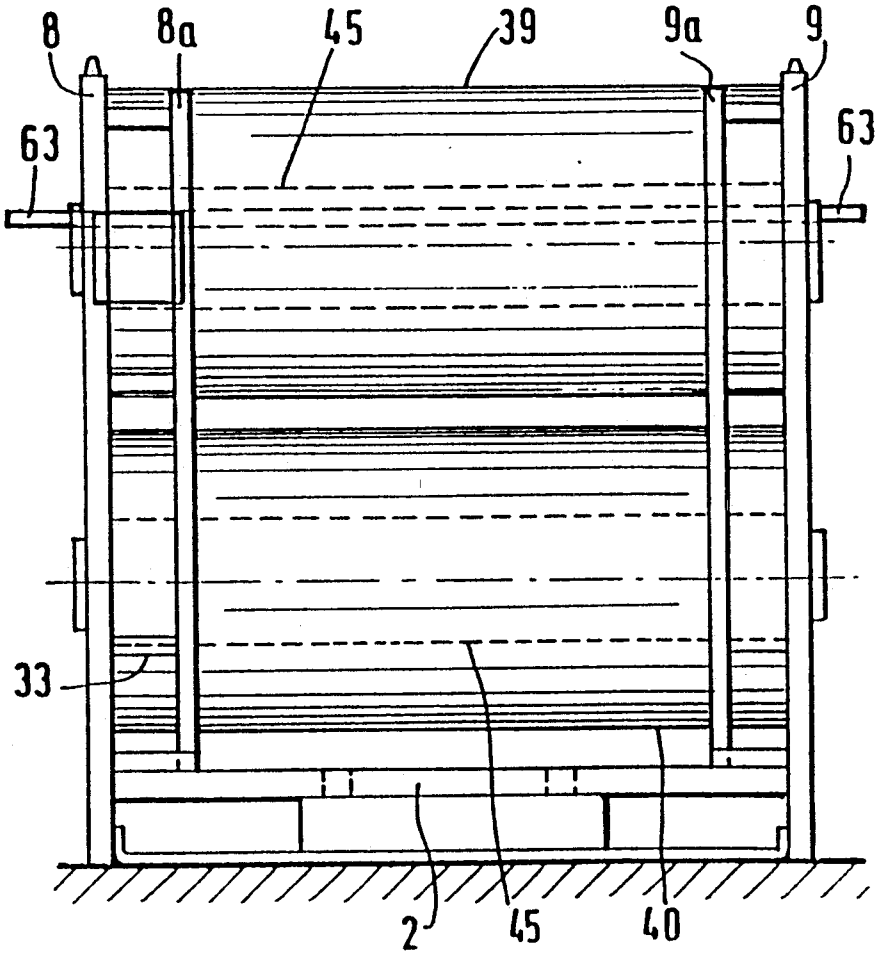
FIG. 5 is a transverse elevational view of the pallet structure of FIG. 4.
Figure 4:
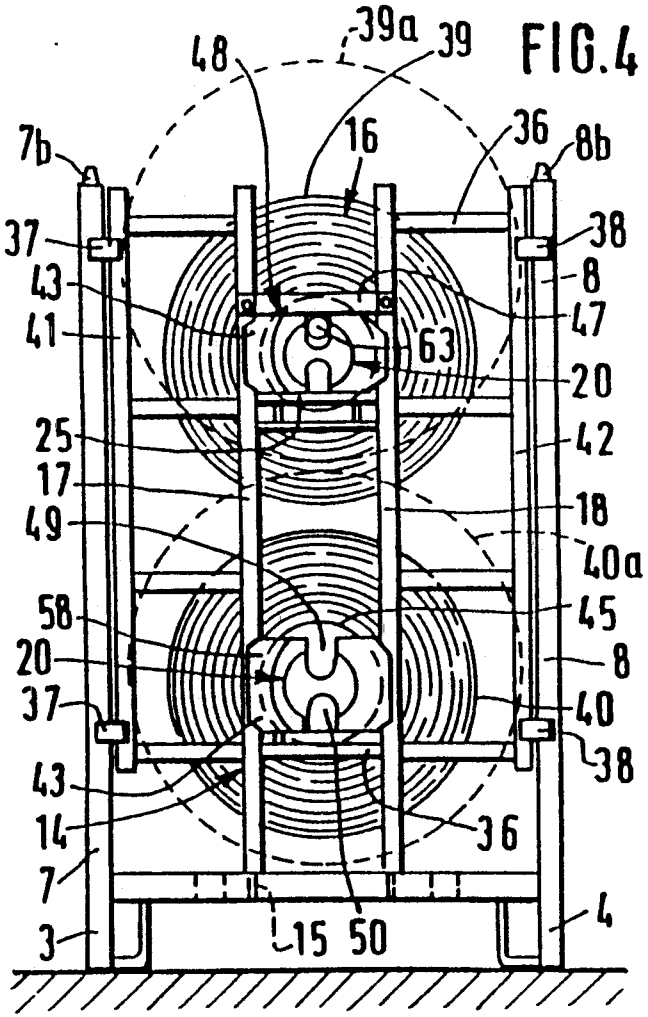
FIG. 4 is a side elevational view of another embodiment of the pallet structure provided with tubular elements disposed longitudinally in the structure.

In FIGS. 4 and 5 a standard pallet, for example built on a standard 800×1200 mm base, is shown fitted to carry rolls of industrial film material 39 and 40 of large dimensions, the rolls being arranged longitudinally in the pallet with their end portions supported on the holder members 20 housed in the open area 16 of a panel 14 which occupies the whole lateral side of the pallet. The parts which are identical to parts in FIGS. 1 and 2 carry the same reference numerals. Panel 14 consists of four vertical tubular elements 17, 18, 41, 42, the central elements 17 and 18 being terminated at the lower ends thereof by pin members 15 which fit into corresponding holes of a cross member of the pallet base 2 and define the lateral sides of the open area 16. The lateral vertical tubular portions 41 and 42 do not extend over the whole height of the pallet and carry on each of their sides (the inner and outer sides of the pallet) lugs 37 and 38 which bear against the uprights 7 and 8 and which, when the pallet is in position, constitute means for rendering them integral with the uprights 7 and 8.

Figure 7:
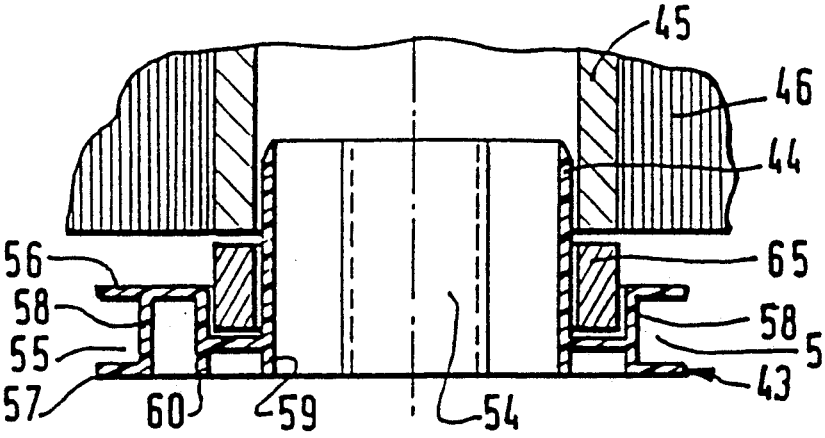
FIG. 7 is a sectional view of the holder member of FIG. 6 taken along the line VII—VII thereof.

The holder members 20 for the ends of a central tube principally comprise, firstly, a part 43 in the general form of a rectangular plate carrying guiding means 21 to 24 and, secondly, a projecting tube support part 44 fixed rigidly thereto extending perpendicularly to the plate part 43 and having the general shape of a tubular stub designed to be introduced into the support tube 45 of a roll 46 (see FIG. 7). For this purpose, the tube support part 44 has a diameter that is slightly less than the inside diameter of the central tube 45 of roll 46.

The tube end holder member 20 which is located towards the upper part of the pallet can be locked in position in order to deal with the eventuality of the pallet overturning and to prevent rolls 39 and 40 from accidentally escaping from the pallet when the holder members 20 are no longer in abutment with the cross members 25 due to the weight acting on them. To achieve this, a second detachable cross member 47 as shown in FIG. 4, identical to cross member 25, is rigidly mounted in position above the upper edge 48 of the holder member 20 and retains holder member 20 in position in the open area 16 in all directions.

Figure 6:
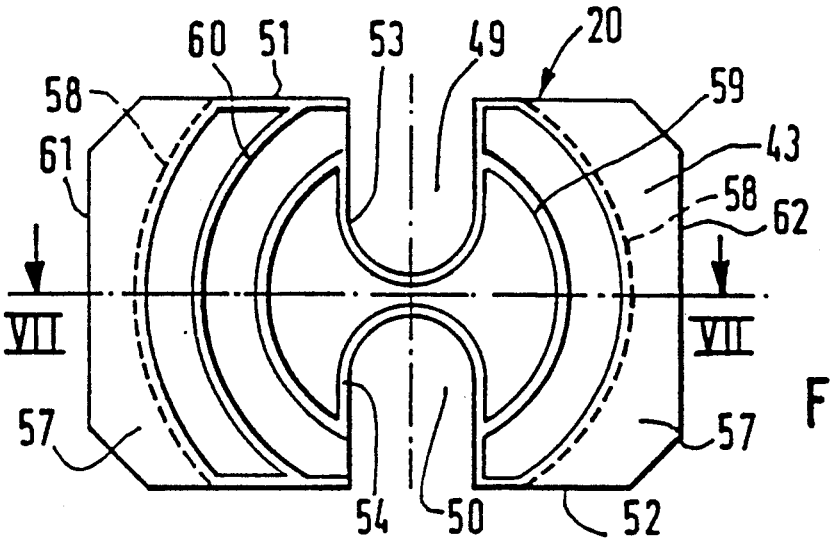
FIG. 6 is an end view seen from outside of a holder member for supporting the end of a central tube, this holder member being designed to be employed in the pallet structure according to the present invention.
Figure 8:
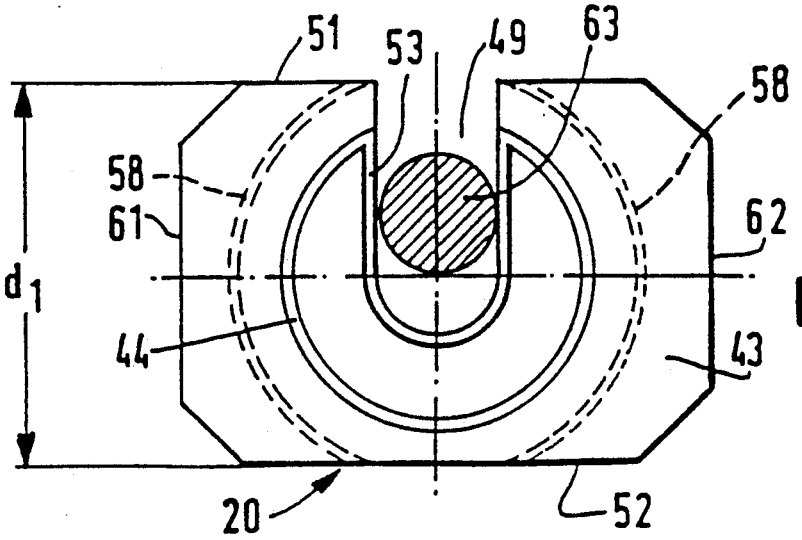
FIG. 8 is an end view seen from the side that supports the tube of a simplified holder member for the structure in accordance with the invention, with a hoisting bar inserted.

In the embodiments of the holder member 20 shown in FIGS. 6 to 8, the rectangular plate part 43 and the cylindrical shaped part 44 for supporting tube 45 are provided with a single lateral passage 49 in the embodiment shown in FIG. 8 or with two lateral passages 49 and 50 in the embodiment shown in FIGS. 6 and 7. The passages 49 and 50 lie on the vertical axis of the rectangular plate part 43 when the pallet is in use and the mouth of each passage opens at a respective upper side 51 or lower side 52 of the rectangular plate part 43 after having passed through the cylindrical support part 44. In the cylindrical support part 44, the passage 49 or 50 is surrounded by a wall 53 or 54 which joins the cylindrical wall of the tube support part 44 the strength of which is thus only slightly reduced due to the existence of the passage.

The guiding means provided on each lateral edge of the holder member 20 can be constituted by a rectilinear channel adapted to slide over a rectangular or square cross-section upright defining the lateral edge of the slotted portion 16, as indicated for the channels 20*a* and 20*b* with reference to FIG. 1. In the embodiments shown in FIGS. 6 to 8 where the holder member 20 is provided in a one-piece plastics material, the channel 55 provided on each lateral side of the holder member 20 through the provision of projecting flanges 56 and 57 has a cylindrical base 58. The channel 55 is adapted to slide over the square or rectangular cross-section upright 17 or 18 constituting the edges of the slotted portion 16.

In FIG. 6, the holder member 20 is shown viewed from the end opposite the cylindrical support part 44, in other words from the end that is located externally of the pallet. As can be seen in the cross-sectional view of FIG. 7, ribs 59 and 60 are provided for increasing the rigidity of the rectangular plate part 43, these being respectively provided around the cylindrical part 44 and between this part 44 and the cylindrical base of the channel 55.

The other sides 51, 52, in other words the sides that do not constitute the guiding edges, are parallel to each other and are spaced from each other by a distance dl (see FIG. 8) which is slightly less than the distance d corresponding to the width of the slotted portion 16, so that after rotating the rectangular plate part 43 of the holder member through 90°, the latter can be removed axially through the slotted portion 16. In order to facilitate axial removal of the holder member 20, the roll 46 (or 39, 40) can be slightly raised, typically by about 10 cm, using a wide sling or a lift truck fitted with a cradle which is introduced laterally through the side of the pallet as shown in FIG. 2. The load is hence removed from the holder member 20 and the holder member itself is raised out of contact with the cross member 25. In this situation, it is possible to cause the rectangular plate part 43 to rotate with the cylindrical base of channel 55 continuously in abutment against one of the edges of the open area 16 provided on the uprights 17 and 18. When the plate part 43 has been rotated between the lateral sides of the open area 16 through 90° with respect to its load bearing position shown in FIG. 4 or in FIGS. 6 and 8, it is possible to axially withdraw the rectangular plate part 43, since it has a width dl allowing it to pass through the opening of the wider open area 16.

In the simplified embodiment of the holder member 20 shown in FIG. 8, one single passage 49 is provided which is vertically centered on the rectangular plate part 43 and in which a rod member 63 is able to slide. The contact area at the lower edge 52 which abuts against the cross member 25 is longer and hence stronger than the area of contact in holder member 20 shown in FIG. 6. In the embodiment shown in FIG. 6, the cylindrically-shaped tube support part 44 (see FIG. 7) is disposed eccentrically with respect to the two lateral sides 61 and 62 of the rectangular plate part 43 and to the cylindrical base 58 of the channel 55. By alternatively arranging for one or the other of parallel sides 51 and 52 to be uppermost or lowermost, a lateral offset of the axis of roll 46 is achieved which for example makes it possible to arrange rolls in a slightly staggered manner one above the other inside the pallet while it would not be possible to house such rolls arranged strictly one above the other.

Figure 10:
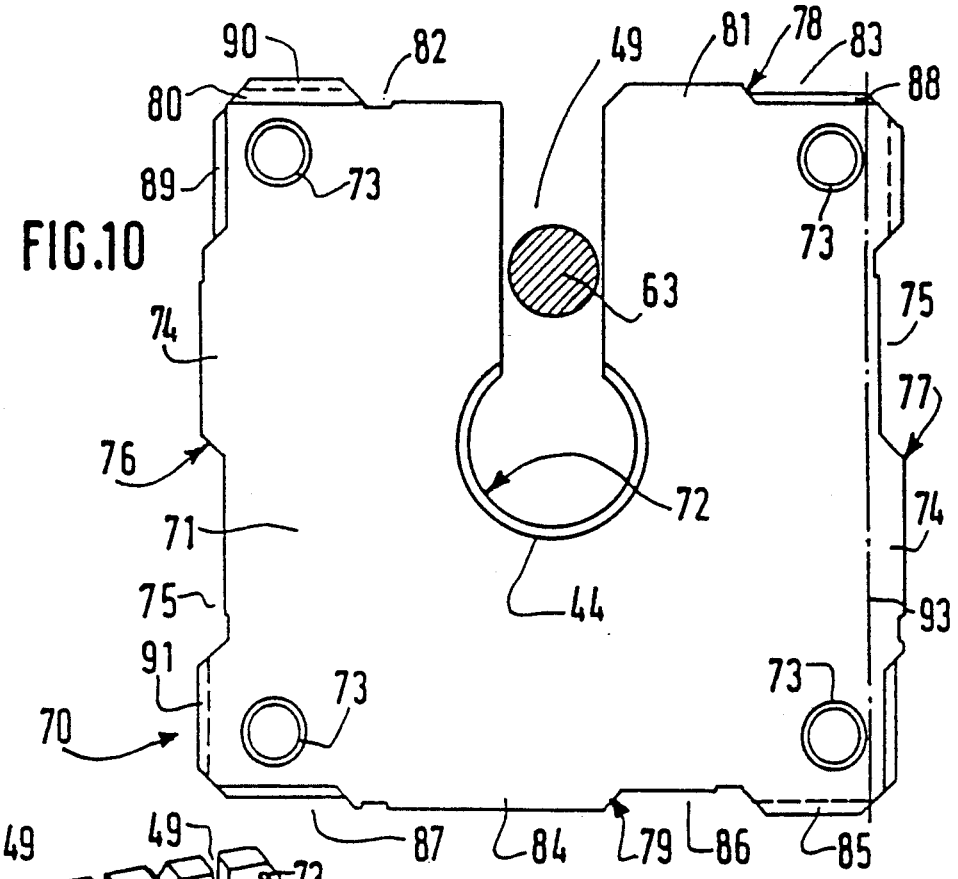
FIG. 10 shows on a larger scale than in FIGS. 6 to 8 and in end view viewed from inside, a further embodiment of a holder member designed to receive tubular elements of reduced outside diameter and which is adapted to be stacked on and/or side-by-side with other identical holder members bearing tubular elements.
Figure 11:
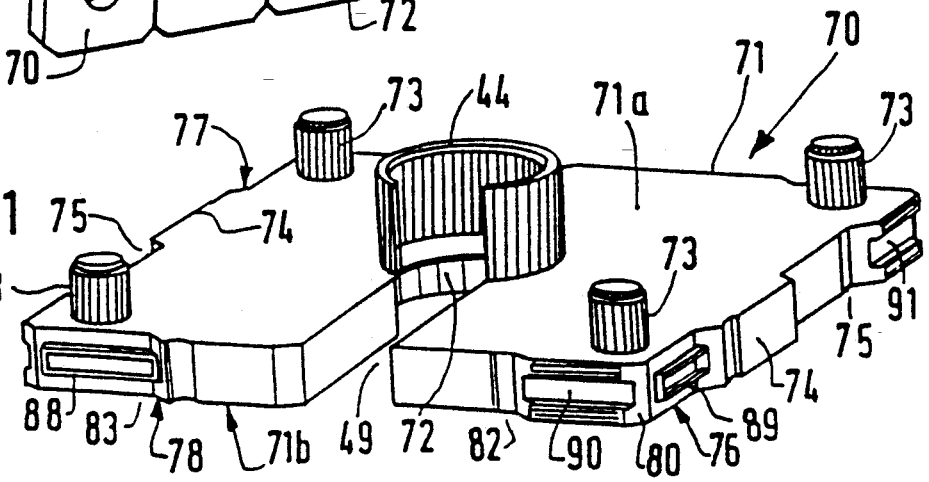
FIG. 11 is a top view in perspective of one slightly modified embodiment of the holder member shown in FIG. 10.

The embodiment of the holder member 70 shown in FIGS. 10 and 11 is designed to be stacked on or side-by-side with another identical holder member when two holder members 70 are each mounted at one end of a tubular element such as a roll of film. In order for stacking to be done heightwise, the tubular elements, unlike the rolls of film 39, 40 or 46, need to have a diameter that is less than the height (see the width dl in FIG. 8) of the area occupied by the holder member. Generally speaking, in order for two-dimensional (heightwise and widthwise) stacking to be possible in order to form stacked blocks of preferably an even number of tubular elements, the outer diameter of the tubular elements needs to be smaller than the smallest side of the rectangular plate that acts as the base of the holder member.

In the embodiment shown in FIGS. 10 and 11, the holder members 70 include, like in the previous embodiments, a base plate 71 of generally rectangular shape which is adapted to slide by means of its lateral sides in a guide channel (not shown) provided on the vertical lateral sides of slotted portion 16, for example on the parallel vertical tubular portions 17 and 18. Base plate 71 includes, like plate 43 of holder member 20, a single lateral passage 49 allowing a rod or bar 63 to slide transversely. Base plate 71 also carries a tube support portion 44 of generally tubular shape interrupted by the single lateral passage 49, arranged to project from its inner side which will be directed towards the tubular element. It will be noticed that tube support 44 surrounds the generally semi-circular shaped base 72 of passage 49 the diameter of the base being greater than the width of the passage. The inner edge of tube support 44 is located directly on the extension of the base 72 of the passage in the embodiment shown in FIG. 10 while, in the embodiment shown in FIG. 11, it is at a certain distance therefrom. The tube support 44 shown in FIG. 11 is better suited to tubes having a larger inside diameter than those intended for use with the holder member 70 shown in FIG. 10.

The inner side 71*a* of base plate 71 (see in FIG. 11, the distinction between the inner side 71*a* and the outer side 71*b* of plate 71) moreover carries in the region of each one of its four outer corners, projecting tubular lugs 73 which for example are employed for centering and engaging purposes when holder members are stacked one on top of each other in a block before being applied to the end of the tubular elements. The lugs 73 can also act as abutment members against the lateral sides of the channels in the uprights into which two opposing lateral edges of base plate 71 engage.

In the embodiment shown in FIGS. 10 and 11, at least two opposing lateral edges of base plate 71 each include at least one projecting portion 74 and at least one recess 75. Projecting portion 74 of lateral edge 76 is adapted to penetrate into the corresponding recess 75 of an opposing lateral edge 77, thus allowing two holder members 70 to be stacked by their base plates 71 in a flat juxtaposed relation, the tube supports 44 being engaged in the tubular elements that are to be supported.

In FIG. 10, it can be seen that the other two opposing lateral edges 78 and 79 also respectively carry, as regards edge 78, projecting portions 80 and 81 and recesses 82 and 83, and as regards edge 79, projecting portions 84 and 85 and recesses 86 and 87. Recess 82 of lateral edge 78, which is relatively long, corresponds to projecting portion 84 of opposing lateral edge 79, but does not correspond to the main projecting portion 74 of the two other opposing lateral edges 76 or 77. This unsymmetrical arrangement of the lateral edges requires that stacking of the holder members 70 be done in a certain stacking direction which corresponds in principle to the one shown, in which the single lateral passage 49 is arranged so as to allow the rod or bar 63 carrying a tubular element such as a roll of film to be extracted upwardly.

The holder member 70 shown in perspective in figure 11 includes supplementary projecting portions and recesses, 88, 89 and 90, 91 respectively, which improve the relative centering of base plates stacked one above the other, thus preventing them from slipping or becoming offset with respect to each other in the forward sense when they are stacked vertically and/or horizontally. The corresponding supplementary projecting portions and recesses are also indicated on FIG. 10 in which each one of the lateral edges of base plate 71 incorporates several projecting portions and several recesses.

Figure 12:
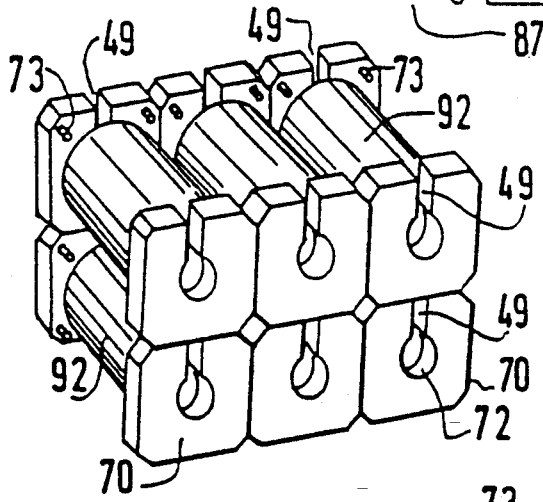
FIG. 12 is a top view in perspective of six rolls of film mounted on their holder members arranged in juxtaposition, stacked and held together in a block outside the pallet structure designed to support their central tubes.

FIG. 12 shows a stack of six rolls of film 92 of smaller diameter than the rolls 39, 40 or 46 shown in previous figures and which are mounted at each end on a holder member 70 carrying a passage 49 for a rod or bar 63, the passage having a circular base 72. The holder members 70 which are not fitted into a pallet structure 1 are here fitted together in a juxtaposed manner by means of their projecting portions and recesses which, by virtue of the lack of symmetry of opposing sets of sides, obliges the arrangement to be such that all the passages 49 are parallel. If it is desired to move the stacked assembly of rolls as a single unit, straps or binding strips can be placed round the complete assembly in a known fashion. When a holder member 70 is engaged into a pallet structure 1, it slides, as explained above, in two parallel vertical channels formed in two parallel uprights defining the vertical sides of a slotted portion 16. The dash-dot line 93 in FIG. 10 defines a peripheral region of varying width beyond tubular lugs 73 on lateral edge 77 which can be engaged into the vertical channel for retaining the base plate 71 of holder member 70 in the forward sense. The lugs 73 act as guide stops at the entry of the vertical channels that receive the edge of base plates 71.

Figure 9:
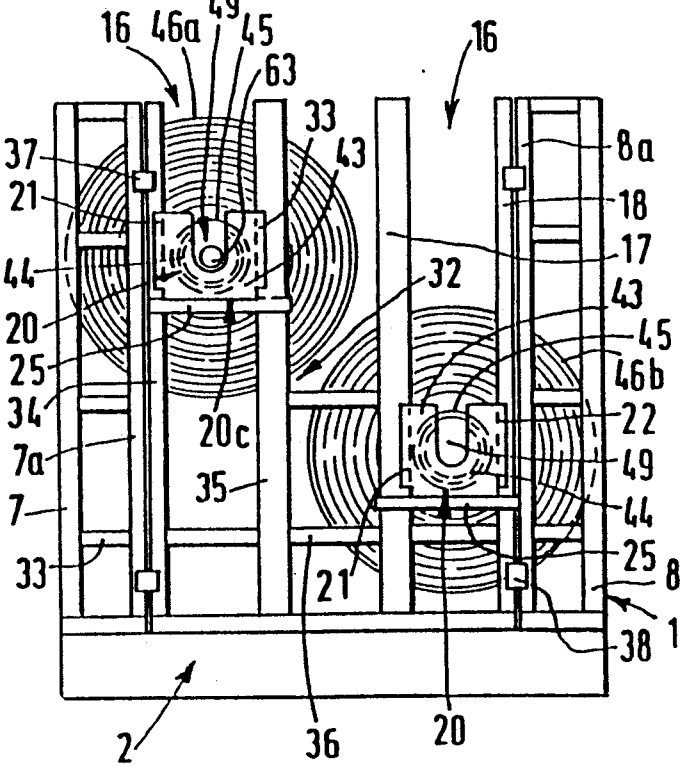
FIG. 9 shows in side elevation a structure of the type shown in FIG. 1 loaded with rolls of film material arranged in a staggered manner.

In FIG. 4, large diameter film material rolls 39*a* and 40*a* are shown in dashed lines which occupy the whole width of the pallet and which extend above the upper edge of the pallet. On one side of the pallet where panel 12, such as shown in FIG. 2 includes two slotted portions 16, it is perfectly possible to mount two rolls of film material side by side or in a staggered arrangement in order to make better use of the parallelepiped shaped inner volume 32 of the pallet 1. Thus, in FIG. 9, it can be seen how two rolls of film material 46*a* and 46*b*, the sum of the diameters of which is greater than the width of the pallet, can be mounted on holder members 20 located at different heights in their slotted portion 16, in order to be fully housed within the available volume 32 of the pallet 1. Identical elements to those in FIG. 1 carry the same reference numerals and it can be better seen how it is possible to introduce a hoisting rod or bar 63 into the passage 50 in order to raise the roll 46*a* together with its holder members 20 which are engaged into the central cardboard support tube 45 for the roll.

A hoist linked to slings or a rod carrier for end introduction (a projecting arm type roll carrier) raises the rod member 63 which moves in the passage 49 through the cylindrical tube support part 44 and comes into contact with the upper internal portion of the roll central tube 45 in order to raise the roll 46*a* which is guided vertically by the combination of the holder members 20 and the uprights 34 and 35. Guiding of the roll 46*a* continues until it is half way out of the inside space or usable volume 32 of the pallet 1 and is no longer in danger of colliding with a wall of the pallet. The roll is thus guided by a twin-rail system close to the inner wall of the pallet without coming into contact with this wall and without the need to insert a protective packaging, representing expense and a possible source of pollution, between the outside of the roll and the inside wall of the pallet. The same operation is repeated when a roll is loaded into the pallet until the holder member 20 at each end of the central tube thereof comes into abutment with the supporting cross member 25.

When a roll of film material has an axial length which is less than the space between two opposing rectangular plate parts 43 but which is nevertheless greater than the distance between the two opposing ends of the tube support cylindrical parts 44, as shown in FIG. 7 at least one spacing insert ring 65 can be mounted on at least one of the tube support parts 44 in order to laterally retain the roll of film material while simultaneously supporting it at its ends on the tube support parts 44.

Loading of the cylindrical objects, notably rolls of film material rolled onto central cardboard tubes 45 with holder members fitted onto the ends thereof, is carried out from above after engaging the cylindrical tube support parts 44 of the holder members 20 inside the ends of tube 45 of the cylindrical object 46. The cylindrical object 46 is then loaded into the pallet by allowing the holder members 20 to slide in the slotted portions 16, the lateral edges thereof providing a guiding function. The holder members 20 then come into abutment with the cross members 25 which have been previously fitted at the correct position or positionally adjusted during loading as was described in connection with FIGS. 3*a* and 3*b*. n order to load the rolls, it is possible to support them by means of slings but the procedure which presents the least risk of damaging the rolls consists in carrying them on a hoist rod member 63 which passes longitudinally through the roll central tube 45, the rod member 63 being carried at the two ends thereof by cables or slings or, alternatively, being supported at one end by a moving rod retainer.

In order to extract the cylindrical objects or rolls of film material from the pallet, a wide sling or a cradle arrangement can be used to lift them through several centimetres in order to release the holder members 20 from their load and bring them out of contact with the cross members 25. It is then possible to slide the holder members 20 within the slotted portion 16 or to turn them in order to remove them axially through the opening d of the slotted portion, the roll of film material then being able to be freely removed in the upward direction.

The pallet 1 and its holder members 20 can be used for transporting rolls of film material but they can of course be used for any type of tubular body that needs protecting. The pallet avoids the need to provide a packaging for the rolls of film material and thus eliminates use of packaging materials. In order to protect the rolls from deterioration resulting from dropping of material during transport or storage, the upper portion of the pallet can be covered with a removable flexible tarpaulin-like cover which constitutes an accessory for the pallet 1 and hence does not constitute an item requiring disposal.

The present invention is obviously not limited to the embodiments which have been described and illustrated but may be subject to numerous modifications available to those skilled in the art without this leading to departure from the scope of the invention.

What we claim is:

1. A pallet for carrying cylindrical objects of variable outside diameter supported by a central tube thereof, said pallet comprising a pallet base of generally rectangular shape carrying uprights secured at four corners thereof between which at least two detachable support means are fitted to said base on opposite sides thereof, each support means comprising a pair of vertical members, said support means being parallel to one another, said support means including means for mounting them on said pallet base and means for rendering them integral with the uprights, each of said vertical members including side walls said support means including, at least at an upper region, an an open area located between opposing side walls, said opposing side walls provided with guiding means adapted to cooperate with matching guiding means of a holder member for an end of said central tube, said holder member resting on a detachable cross member extending between said opposing side walls and adapted to be fitted at differing levels within said open area.

2. A pallet according to claim 1 wherein two sets of detachable support means are on said opposite arranged sides of said pallet between said uprights, and widest sides of the pallet including at each end thereof a supplementary upright linked by bracing members to a corresponding corner upright, the supplementary uprights of one side being spaced from each other by a distance that corresponds to the width of said panel.

3. A pallet according to claim 1 wherein said support means comprises at least four vertical tubular parts mutually connected by bracing members, the lateral wall of each outside tubular part thereof cooperating with said uprights by means of rigid fixing means while said open area is formed between two middle tubular parts.

4. A pallet according to claim 1 wherein said support means comprises by at least four vertical tubular parts mutually connected by bracing members, the lateral wall of each outside tubular part thereof cooperating with said uprights by means of rigid fixing means while said open area is formed between a lateral tubular part and a middle tubular part.

5. A pallet according to claim 1 wherein lateral sides of said side walls are each formed by a tube of rectangular cross-section carrying means for securing said detachable cross member at corresponding differing levels.

6. A pallet according to claim 1 wherein said support means are constituted by an assembly of tube portions each having the same cross-section.

7. A pallet according to claim 1 wherein an upper region of at least one of said corner uprights includes a projecting portion adapted to fit into a corresponding cavity provided in a foot of the pallet base of another pallet, said cavity being provided in a lower region of a corner upright to enable stacking of the pallets.

8. A pallet according to claim 1 wherein said holder member is adapted to be locked in position by means of a second removable cross member.

9. A pallet according to claim 1 wherein said holder member includes a portion generally in the form of a rectangular plate on at least two parallel lateral sides of which means for guiding are provided which cooperate with said guiding means provided on said opposing side walls and wherein said rectangular plate part carries on one side thereof and projecting perpendicularly therefrom, a tube support part of generally cylindrical shape and of diameter slightly less than the inside diameter of the central tube that is to be supported.

10. A pallet according to claim 9 wherein said rectangular plate part and said tube support part are provided with a passage lying on the vertical axis of said plate part and a mouth of which lies on a side which is not a lateral side thereof.

11. A pallet according to claim 10 wherein said passage in said tube support part is surrounded by a wall which joins the cylindrical wall of said tube support part.

12. A pallet according to claim 9 wherein said rectangular plate part and said tube support part are provided with two passages lying in vertical axis of said plate part and mouths of which lie on different sides which are not a lateral side thereof.

13. A pallet according to claim 12 wherein passages in said tube support part are surrounded by a wall which joins the cylindrical wall of said tube support part.

14. A pallet according to claim 9 wherein means for guiding on each lateral side of said holder member are made up by a rectilinear channel adapted to slide on a rectangular cross-section tube defining a lateral edge of said open area.

15. A pallet according to claim 9 wherein means for guiding on each lateral side of said holder member are made up by a channel having a cylindrical base adapted to slide on a rectangular cross-section tube defining the lateral edge of said open area.

16. A pallet according to claim 9 wherein two parallel sides of said holder member which are not the lateral sides thereof are spaced from each other by a distance dl which is slightly less than the width d of said open area whereby, after rotation through about 90° of said rectangular plate part, said holder member can be withdrawn axially from said open area.

17. A pallet according to claim 9, wherein said tube support part is located eccentrically with respect to two lateral edges of said rectangular plate part.

18. A pallet according to claim 9 wherein at least one annular spacing insert is mounted on said tube support part of said holder member.

19. A pallet according to claim 1 wherein said detachable cross member is made up by two bars consisting of a load-bearing bar supporting said holder member the length of which is greater than the distance d between the opposing side walls, and of a locking bar the length of which is slightly less than said distance d between the opposing side walls, said two bars being linked by cross-pieces disposed substantially perpendicular thereto, the outermost ones of which are located at a distance from each end of said load-bearing bar whereby a length of said load-bearing bar that is greater than half the difference in length between the two said bars is left free.

20. A holder member for use in association with a pallet in accordance with claim 1 comprising a part in the general shape of a rectangular plate on at least two parallel lateral sides of which means for guiding are provided which are adapted to cooperate with guiding means on said opposing side walls and wherein said rectangular plate part carries on one side thereof and projecting perpendicularly therefrom a tube support part of generally cylindrical shape and of diameter slightly less than an inside diameter of the central tube to be supported.

21. A holder member according to claim 20 wherein said rectangular plate part and said tube support part are provided with a passage lying in a vertical axis of said plate part and a mouth of which lies on a side which is not a lateral side thereof.

22. A holder member according to claim 21 wherein said passage in said tube support part is surrounded by a wall which joins the cylindrical wall of said tube support part.

23. A holder member according to claim 20 wherein said rectangular plate part and said tube support part are provided with two passages lying in a vertical axis of said plate part and mouths of which lie on different sides which are not a lateral side thereof.

24. A holder member according to claim 23 wherein said passages in said tube support part are surrounded by a wall which joins the cylindrical wall of said tube support part.

25. A holder member according to claim 20 wherein means for guiding each lateral side of said holder member are made up by a rectilinear channel adapted to slide on a rectangular cross section tube defining a lateral edge of said open area.

26. A holder member according to claim 20 wherein means for guiding each lateral edge of said holder member are made up by a channel having a cylindrical base adapted to slide on a rectangular cross section tube defining a lateral edge of said open area.

27. A holder member according to claim 26 wherein two parallel sides of said holder member which are not lateral sides thereof are spaced from each other by a distance dl which is slightly less than a width d of said open area whereby, after rotation through about 90° of said rectangular plate part, said holder member can be withdrawn axially from said open area.

28. A holder member according to claim 20, wherein said tube support part is located eccentrically to the two lateral edges of said rectangular plate part.

29. A holder member according to claim 20, wherein at least two opposing lateral edges each include at least one projecting portion and at least one recess and wherein the projecting portion of a first edge is adapted to penetrate into a corresponding recess of a lateral edge opposing said first edge, whereby at least two holder members can be mutually stacked by juxtaposition of rectangular plate parts.

30. A holder member according to claim 29, wherein four lateral edges of said holder member incorporate at least one projecting portion and at least one recess, a projecting portion of one lateral edge only matching a recess of an opposing lateral edge of said holder member whereby only one single stacking orientation of a plurality of said holder members is possible.

31. A holder member according to claim 29, wherein four lateral edges of said holder member incorporate at least one projecting portion and at least one recess, a projecting portion and a recess of one lateral edge only matching respectively a recess and a projecting portion of a opposing lateral edge of said holder member whereby only one single stacking orientation of a plurality of said holder members is possible.

* * * * *